United States Patent [19]

Leuvering

[11] Patent Number: 4,569,182

[45] Date of Patent: Feb. 11, 1986

[54] METHOD OF AND APPARATUS FOR PACKAGING

[75] Inventor: Hans Leuvering, Lubbecke, Fed. Rep. of Germany

[73] Assignee: Leifeld & Lemke Machinenfabrik GmbH & Co., Ahden, Fed. Rep. of Germany

[21] Appl. No.: 583,001

[22] Filed: Feb. 23, 1984

[30] Foreign Application Priority Data

Mar. 4, 1983 [DE] Fed. Rep. of Germany ..... 3307855

[51] Int. Cl.[4] ..... B65B 7/20; B65B 11/12

[52] U.S. Cl. ..... 53/456; 53/207; 53/374; 53/383; 53/462; 53/491; 53/508; 53/558

[58] Field of Search ..... 53/207, 209, 208, 374, 53/383, 456, 458, 461, 462, 484, 491, 507, 508, 564, 566, 575, 558; 493/123, 124, 125, 126, 127, 316

[56] References Cited

U.S. PATENT DOCUMENTS

| | | | |
|---|---|---|---|
| 2,945,334 | 7/1960 | Perrault | 53/374 |
| 3,323,275 | 6/1967 | Kingsbury et al. | 53/462 |
| 3,879,920 | 4/1975 | Langen | 53/374 |
| 3,968,623 | 7/1976 | Langen | 53/575 |

*Primary Examiner*—Robert L. Spruill

*Assistant Examiner*—Michael D. Folkerts

[57] ABSTRACT

A wrap-around packaging method wherein a package blank is prefolded to an open-sided configuration, an object to be packaged is positioned within the prefolded blank and the final folding and adhesive closing of the package is then completed in a series of synchronized steps. The prefolding occurs during the course of withdrawal of the package blank from a magazine and its transporting into position to receive the object to be packaged and includes plural folding steps which are individually performed to minimize stress on the packing material. The movement of the preformed packing material blank and object through the final folding and closing stations is accomplished without contact between the conveying means and the object.

39 Claims, 8 Drawing Figures

METHOD OF AND APPARATUS FOR PACKAGING

BACKGROUND OF THE INVENTION (1) Field of the Invention

This invention relates to packaging and particularly to the automatic formation of cartons around materials and articles including those which may be relatively fragile. More specifically, the present invention is directed to apparatus for producing packages and especially to apparatus wherein a packing material blank is folded completely or partially around the article or material to be packaged. Accordingly, the general objects of the present invention are to provide novel and improved methods and apparatus of such character.

(2) Brief Description of the Prior Art

Techniques and machinery for producing what is known in the trade as "multipacks" are well-known. Prior "multipack" producing techniques operate in accordance with either one of two methods, i.e., the vertical method or the horizontal method. In the vertical method, which is also referred to as the "lowering method", the item to be packaged is deposited on a flat package blank. Thereafter, the item and the blank are drawn or pushed vertically through a forming station. During the vertical movement the side and top faces of the blank are deflected upwardly, the closure flaps of the side faces of the blank are folded inwardly and, finally, the closure flaps of the bottom face are folded. The folding of the top face and top face closure flaps, to complete the package, occur in subsequent operations. Rapid-bonding fusion adhesives are used to seal the thus produced "multipack".

In the previously employed horizontal method of forming "multipacks", also referred to as the "push-through" method, the articles to be packaged are positioned against a vertically supported or right-angle prefolded package blank. Thereafter, the article or articles and package blank are pushed through forming and pressing members. During this pushing operation the closure flaps of the rear side face and the bottom and top faces, or alternatively only the top face, are folded inwardly. Subsequently, the front side face and the remaining closure flaps are folded. Finally, the packages are completed by sealing through the use of rapid-bonding fusion adhesives.

Neither of the above briefly described "multipack" forming methods has proven to be entirely satisfactory. The principal deficiency of the vertical and horizontal "multipack" forming methods is that significant force must be exerted on the articles to be packaged in order to simultaneously transport the articles and the package blank through the forming and folding stations of the packaging machine. Accordingly, articles or materials which are sensitive to pressure cannot be packaged in a "wrap-around" machine which operates in accordance with the prior art vertical and horizontal packaging methods. Since the prior art "multipack" forming procedures require that the articles being packaged have a high inherent strength, in order to avoid deformation and breakage, such procedures have had limited utility.

It is also to be observed that the packaging material required for prior machines which employ the vertical and horizontal "multipack" forming method must be of high quality. Even with the use of such high quality packing material it is impossible to exclude the possibility of damage to the material as it passes through the forming and folding stations. Thus, the prior art techniques and apparatus, as briefly described above, preclude the use of less expensive packaging materials and particularly recycled materials.

SUMMARY OF THE INVENTION

The present invention overcomes the above-briefly discussed and other deficiencies and disadvantages of the prior art by providing a novel and improved method of and apparatus for producing "multipacks". In accordance with the present invention the articles or materials to be packaged and the packaging material itself are treated carefully and gently while, at the same time, strong dimensionally stable packages are formed.

In the practice of the present invention a packaging material blank is pre-formed, about the longitudinal edges of the final package, to define a partial package which is supported on its bottom face. This partial package will be a generally C-shaped if the package is to be completely wrapped around the article to be packaged and will be generally L-shaped in cases where the packaging material is to be wrapped only partially around the article. The article to be packaged is deposited in the partially formed package, i.e., the C-shaped or L-shaped pre-formed packing. Next, a first flap, which is located oppositely of the base portion of the partial package, is folded in to capture the article which has been positioned on the bottom face of the packaging material blank. Thereafter, the combination of the partially formed package and article is conveyed, in a timed manner, through a series of folding stations. During movement through the folding stations transport members act solely on the packaging material and do not contact the article being packaged. In accordance with the preferred mode of practice of the present invention the pre-folding of the packaging material blank about the longitudinal package edges occurs in the course of the withdrawal of the blank from a stack of blanks and the feeding of the blank to the loading station where the article is deposited thereon, such pre-folding forming the above-mentioned partial package which is either generally C-shaped or generally L-shaped.

Apparatus in accordance with the present invention comprises a "laying-on" station wherein package blanks are singly withdrawn from a magazine, partly folded and delivered to the loading station of a transport mechanism. At the loading station articles to be packaged are delivered to and deposited on partly folded blanks. The apparatus further comprises means for conveying the articles and blanks through plura folding stations. Apparatus at these folding stations folds in the side faces and closure flaps to complete the packaging procedure. The apparatus of the "laying-on" station is characterized by separating means which engages a packing material blank at its bottom face and feeds said blank to the transport plane. The apparatus of the "laying-on" station further includes a guide which defines the transport plane and is disposed at a right angle with respect thereto, a folding member which acts on the upper portion of the blank during the feeding of the blank to the transport plane, means for moving the packing material blank to the loading station, and guide members which act on the packing material blank during movement to the loading station to fold the upper and rear side faces in such a manner as to complete formation of the partial package. The conveying means of apparatus in accordance with the present invention has a controlled movement cycle, operating in timed fashion, with slow start and finish. This conveying means includes at least a pair of transporters which are moveable from below into the path of movement of the packaging material/article combination and which clamp the combination during movement.

The method and apparatus of the present invention cause prefolding of the packing material blanks about defined the junctions, i.e., edges, between adjacent connected sides of the final package and thus insures careful treatment of the packaging material. That is, the prefolding technique of the present invention removes tension from the packaging material since it is accomplished with care by means of a series of consecutively performed steps, i.e., the pre-folding occurs in a relatively long phase. Thus, there is very little stressing of the exposed surfaces of the packing material and, accordingly, the present invention permits the use of less expensive packing materials and thus results in a reduction in the cost of forming "multipacks".

The method and apparatus of the present invention also guarantee that the article or material being packaged will suffer no detrimental effects from the packaging procedure. Thus, in accordance with the present invention, during the transporting of the "pack unit", i.e., the combination of the item to be packaged and the partially formed package, the articles or materials being packaged are not stressed in part because the transport members act only on the packaging material and do not directly contact the article or material being packaged.

In the method of the present invention, before the transport of the "pack unit" begins, a flap is folded upwardly behind the article or material being packaged, this flap being known in the trade as the "industry edge". This "industry edge" is coated on its outwardly facing side with an adhesive and will not be visible in the completed package. Accordingly, the ability to use the package for advertising purposes is enhanced and the adhesion of the portions of the package which are bonded to the "industry edge" is improved by reason of the counter-pressure of the article being packaged against the inwardly facing side of the "industry edge".

Also in accordance with the preferred embodiment of the invention, the transporters of the conveying means contact the front and rear side faces of the "pack unit" and insure the alignment thereof in the individual folding stations thereby insuring a strong, dimensionally stable "multipack".

The method of the present invention contemplates the stepwise timed transport from folding station to folding station. This permits the adhesive bonding of flap portions of the packaging material blank to one another to be accomplished during rest phases, and over a relatively long time period, and additionally permits the principal folding operations to be carried out on the stationary packing material. In continuously operating machines of the type known in the prior art an exact folding of the packing material and the application of adhesively coated closure flaps can be accomplished only through the use of apparatus which is technically exceedingly complex.

The method and apparatus of the present invention also permits the user thereof to elect to form full wrap-around packages or partial wrap-around packages.

BRIEF DESCRIPTION OF THE DRAWING

The present invention may be better understood and its numerous objects and advantages will become apparent to those skilled in the art by reference to the accompanying drawing wherein like reference numerals refer to like elements in the several FIGURES and in which.

DESCRIPTION OF THE PREFERRED EMBODIMENT

Figure 1:
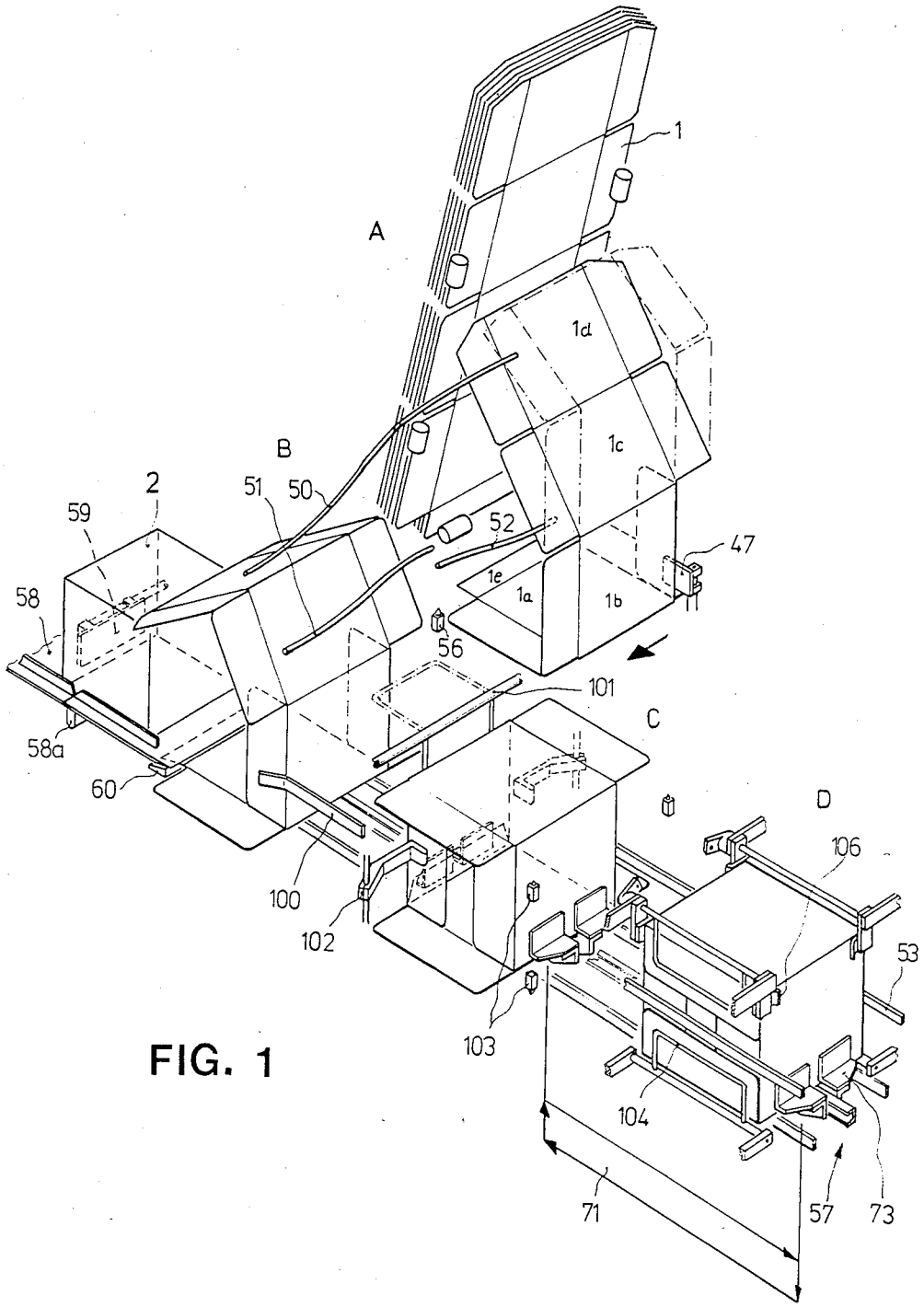
FIG. 1 is a schematic, perspective view of a packaging machine in accordance with the present invention.

FIG. 1 schematically depicts a packaging machine in accordance with the invention. This packaging machine includes a "laying-on" station A, a loading station B, a first folding station C, a second folding station D and conveying means which interconnects the loading station with the first folding station and the first folding station with the second folding station.

Figure 2:
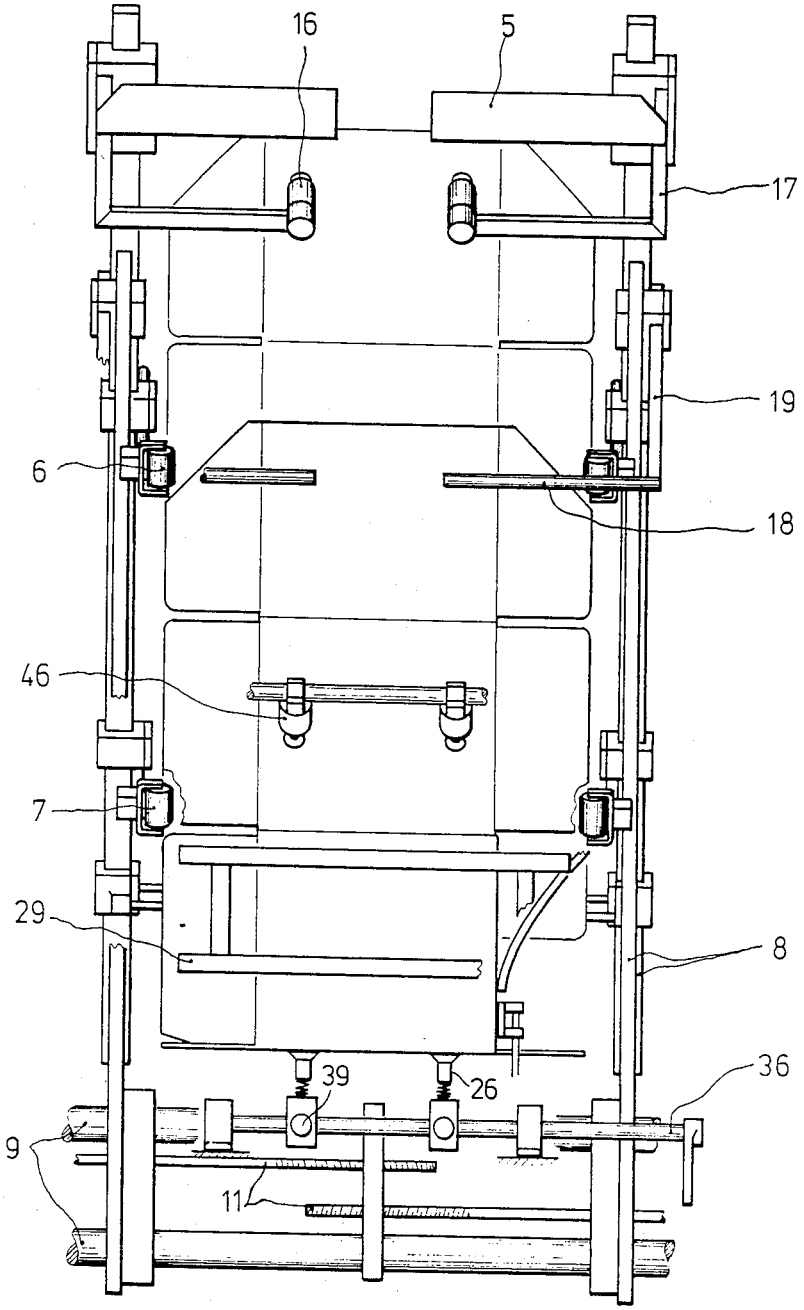
FIG. 2 is a front elevation view, partly broken away, of the first stage of the apparatus of FIG. 1.
Figure 3:
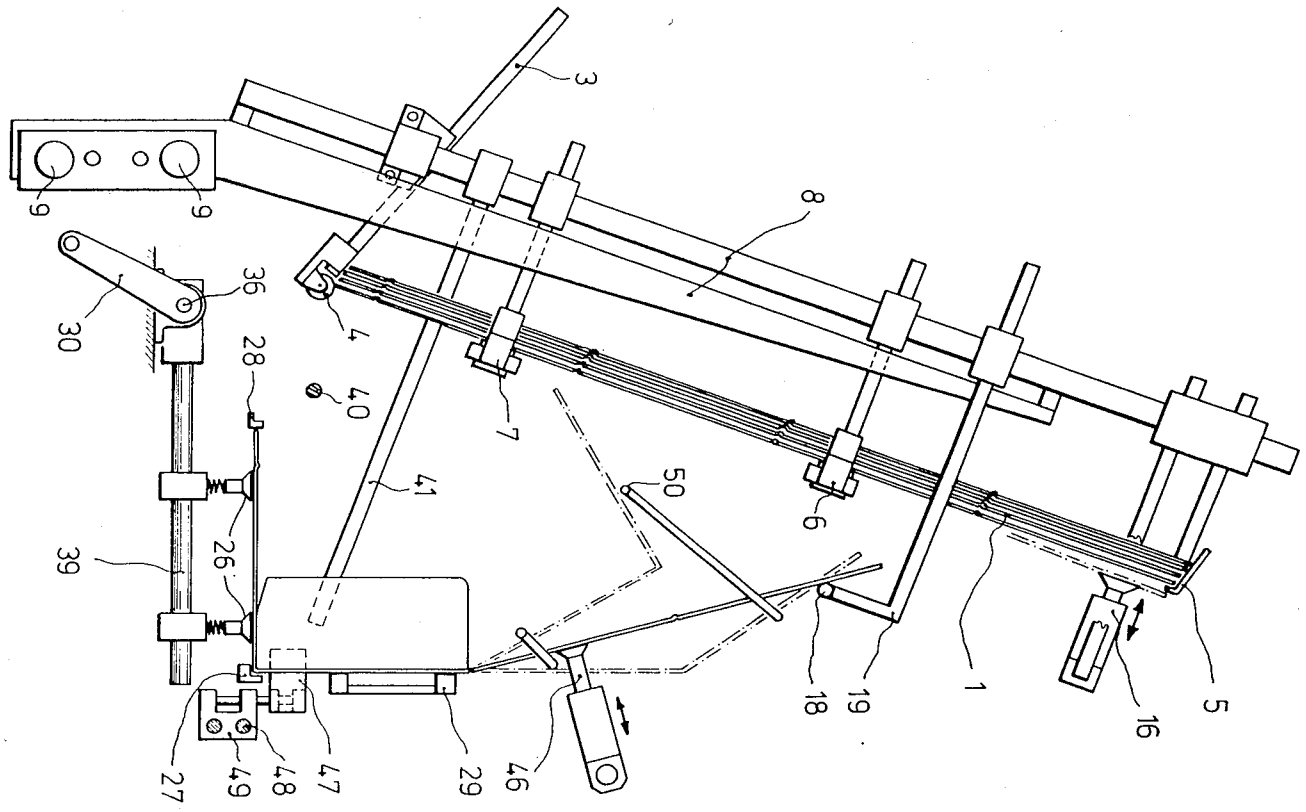
FIG. 3 is a side-elevation view of the apparatus of FIG. 2.

Referring jointly to FIGS. 1–3, the "laying-on" station A includes a magazine wherein a plurality of individual packing material blanks 1 are disposed in an upright and forwardly inclined position. In this upright position the lower edges of the blanks rest upon an inclined support 3 which includes, at its lower-most end, a retainer roller 4. The inclined support 3 also includes, at the upper edge thereof, retainer plates 5. Further pairs of retainer rollers 6 and 7 act on the side edges of the blanks 1 intermediate the upper and lower edges thereof. The support 3, plates 5 and the various rollers are connected to laterally extending frame members 8. The frame members 8 are mounted on guide rods 9 and the spacing therebetween can be adjusted via threaded spindles 11 to the appropriate format width.

The packing material blanks are withdrawn from the bottom of the magazine. In order to avoid double withdrawals, due to the suction plate effect between two flat sheets which bear against one another, the first step of the withdrawal procedure is the lifting of the lowermost blank in the magazine. This lifting step, which may be termed a preliminary release, is accomplished thrugh the use of vacuum suction members 16 which cooperate with the upper portions of the blanks 1. The vacuum suction members 16 are supported, by means of angled arms 17, from the side frame members 8. A pair of oppositely extending folding rods 18 are also mounted from the side frame members 8, as may best be seen from FIG. 3, by means of angled arms 19.

In order to facilitate understanding of the invention the faces of the packing material blanks have been designated by separate reference characters on FIG. 1. Thus, the bottom face is indicated at 1*a*, the front side face at 1*b*, the upper side face at 1*c*, the rear side face at 1*d* and the "industry edge", i.e., a closure flap which will be adhesively coated, is designated at 1*e*.

The actual withdrawal of a packing material blank 1 from the magazine, after the preliminary release accomplished with the vacuum suction members 16, is achieved through the use of further pairs of vacuum suction members 26. The members 26 engage the bottom face portion 1*a* of the blank and withdraw the blank from the magazine in such a manner that it is deposited in a horizontal transport plane defined by an angled guide 27 and a guide rail 28. The motion of the suction members 26, which is provided in the manner to be described below, causes the front side face 1*b* of the blank, seen in the direction of motion, to move into contact with a stop 29 and thus to assume a right-angled position relative to the bottom face 1*a*.

The pairs of vacuum suction members 26, as may be seen from joint consideration of FIGS. 2 and 3, are mounted on shafts 39 which, in turn, are connected at first ends thereof to a rotatable drive shaft 36. The rotation of shaft 36, to thereby impart pivotal motion to the shafts 39, is effected by means of a drive arm 30. The position of the suction member pairs on shafts 39 may be adjusted pursuant to the format adjustment, i.e., the width of the packing material blanks 1.

When the bottom face 1*a* of the packing material blank is drawn into the transport plane, as may best be seen from FIG. 3, the rear side face 1*d* is caused to contact the folding rods 18. Accordingly, the blank is caused to begin to fold about a longitudinal edge which divides the front side face 1*b* from the upper side face 1*c*, i.e., the blank 1 will assume the position shown in solid lines in FIG. 3. As the bottom face 1*a* of the blank is moved to the transport plane, there will be additional prefolding of the blank about the longitudinal edge which divides the flap 1*e* from bottom face 1*a*, i.e., the flap 1*a* is bent inwardly by reason of its contacting a folding rod 40.

The above-described pre-folding procedure continues with the right-angled folding in of the rear closure flap of the front side face 1*b*. The folding in of the rear closure flap of front side face 1*b* is caused by a side guide rod 41 which is also adjustably mounted on one of the side frame members 8.

The pre-folding of the packing material blank 1 about the longitudinal edge which divides the upper side face 1*c* from the rear side face 1*d* is effected by vacuum suction members 46 which engage the upper side face and retract it to the position illustrated in FIG. 3 by a dot-dash line, the rear side face 1*d* being restrained by the folding rods 18 during the retraction of upper side face 1*c*.

Upon completion of the various pre-folding steps described above, the packing material blank will be at least partly folded about all of its longitudinal edges, such edges being defined by scoring or stamping during the cutting of the blanks 1. The pre-folded blank will next be moved into the loading station B (see FIG. 1). For this purpose, the apparatus includes a transporter 47 which is pivotal about a vertical axis into and out of the path of movement and which engages the packing material blank in the region of the fold edge between the front side face 1*b* and its closure flap which has, through the action of the guide rod 41, been folded in at a right-angle. The transporter 47 is rotatably mounted from a carriage 49 which is movable along a pair of guide rods 48. During the transfer of the partially pre-folded packing material blank from the "laying-on" station A to the loading station B, under the pushing action of the transporter 47, the blank 1 is brought into the desired generally C shaped pre-folded form through the action of further guide rods 50, 51 and 52. The guide rod 50 first acts on the rear side face 1*d* to deflect it downwardly while guide rod 52 prevents downward motion of upper side face 1*c*. As the motion from station A to station B continues, the upper side face 1*d* will come into contact with guide rod 51, i.e., guide rod 51 will take over the guiding function of upper side face 1*c* from guide rod 52.

It is to be observed that, during the movement of the pre-folded packing material blank between stations A and B, an adhesive will be applied to the side of flap 1*e* which, in the final package, will face outwardly. The adhesive application nozzle has been indicated schematically at 56 in FIG. 1.

As will be obvious from the above discussion, the packaging material blanks are treated quite gently in the course of their withdrawal from the magazine, pre-folding and delivery to loading station B. This gentle handling includes the pre-folding of the blank in successive steps. Additionally, because of the manner in which the pre-folding is preformed, the forces exerted on the side faces of the blanks are transferred solely into the fold joints, which are usually defined by grooves, which will form the longitudinal edges of the final package. It is also to be noted that there will be at least partial folding, and thus stress relief, about each of these longitudinal edges during the pre-folding operation.

Figure 4:
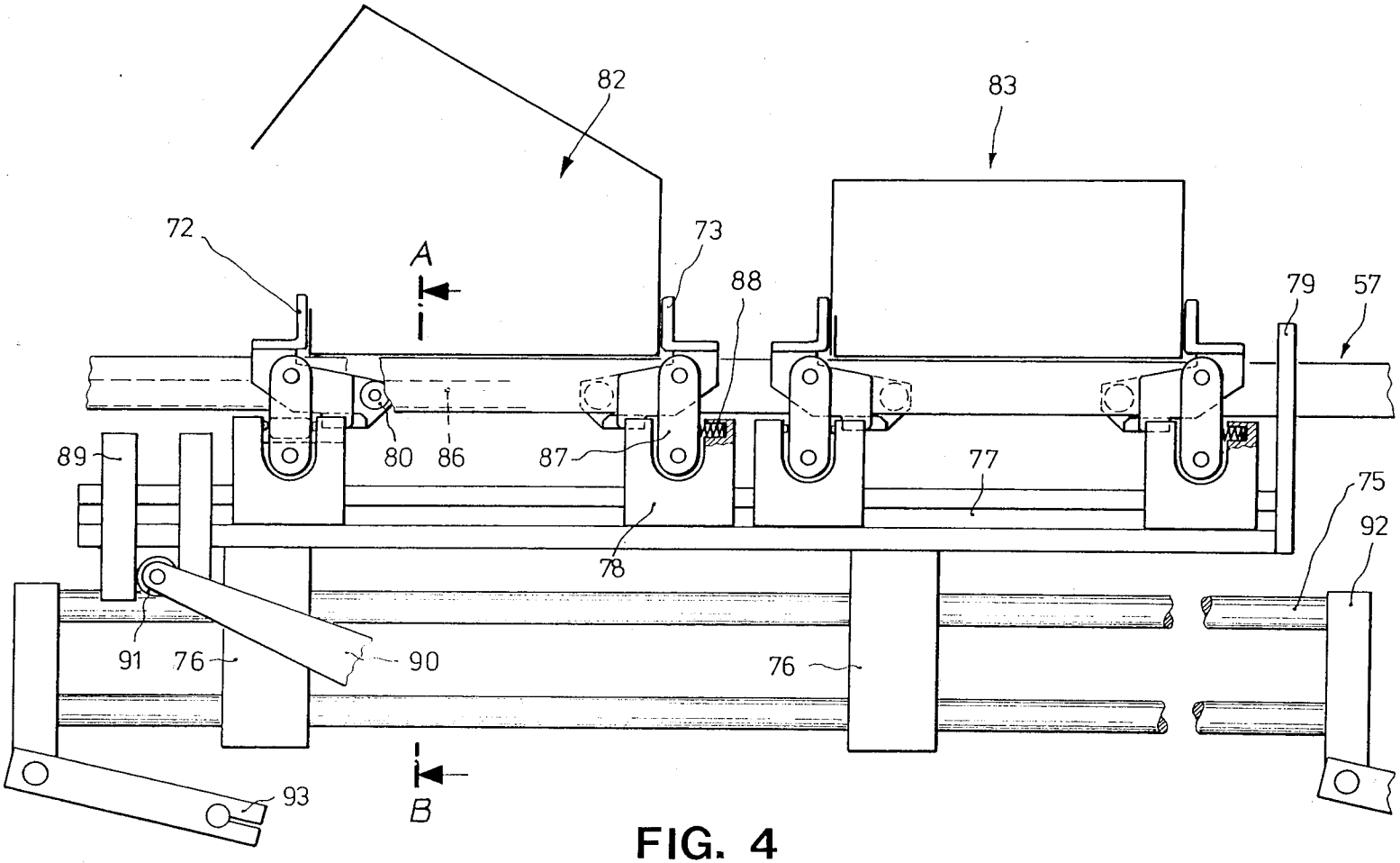
FIG. 4 is a side-elevation view of a portion of the conveying means of the apparatus of FIG. 1, FIG. 4 depicting the loading station and first folding station of the packing machine of FIG. 1.

Referring now jointly to FIGS. 1 and 4, the pre-folded packing material blank, which is generally C-shaped in the example being described, will rest on a table 57 of a conveying means when it has been delivered to loading station B. The table 57 is preceded, in the direction of movement of the articles to be packaged, by an introduction table 58. An article to be packaged, indicated at 2 in FIG. 1, will be gently pushed over table 58 by means of a pusher 59 and into the opened pre-folded partial package. The introduction table 58 will consist of a stationary part and a front part which is pivotal about a horizontal axis 58*a*. The pivotal forward portion of table 58 will ride over the closure flap 1*e* of the blank and thus will keep flap 1*e* below the transport plane during the feeding of an article 2 into the partial package. The pivotal forward portion of table 58 also cooperates with a support 60 to clamp flap 1*e* and thereby prevent motion of the packaging material in the direction of article movement as the article 2 is fed into the partial package. The clamping will, of course, occur in a region or regions which have not been coated with adhesive.

The conveying means, which extends from the receiving end of table 57 at loading station B through folding stations C and D, includes lateral guide strips 53 and a pair of synchronously operating transport units which are indicated in FIG. 4 generally at 82 and 83. The transport units 82 and 83 each have front and rear transporters 72 and 73 between which a "pack unit", i.e., a packing material blank and an article to be packaged supported on the bottom face thereof, is clamped. The movement of the transport units 82 and 83 defines rectangular paths as indicated at 71 in FIG. 1 for transport unit 83. During this rectangular movement the "pack units", starting from the loading station B, are engaged by the transporters 72 and 73, advanced by one station and then released. The speed of movement of the transport units is in accordance with a sinusoidal velocity curve whereby high speed impact of the transporters against the pack unit, which could damage the articles being packaged, is avoided.

Figure 5:
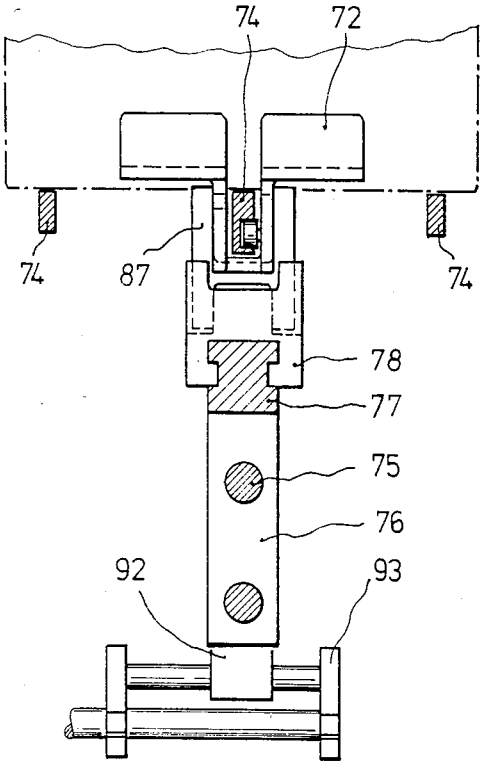
FIG. 5 is a cross-sectional view taken along line A–B of FIG. 4.
Figure 6:
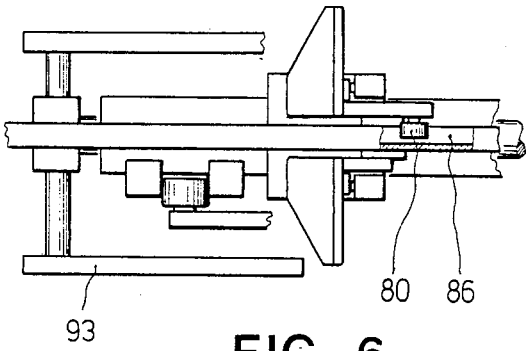
FIG. 6 is a plan view of one of the transporters of the conveying means of FIG. 4.

As may be seen from FIG. 5, the support table 57 is defined by three independent support beams 74 with the transporters 72 and 73 being disposed intermediate the outer-most beams and guided by the intermediate beam. The transport units each include a slide 76 which is movably supported on a pair of guide rods 75. The transport units also include carriers 78 which are mounted on a rail 77, the transporters 72 and 73 being coupled to carriers 78 as may be seen from FIG. 4. The position of and spacing between the carriers 78 on rail 77 may be adjusted in accordance with the format of the "pack unit". A driver 79 is positioned at the end of rail 77 at a defined distance from transport unit 83. The driver 79 will engage a completed package and move such completed package out of folding station D.

Figure 7:
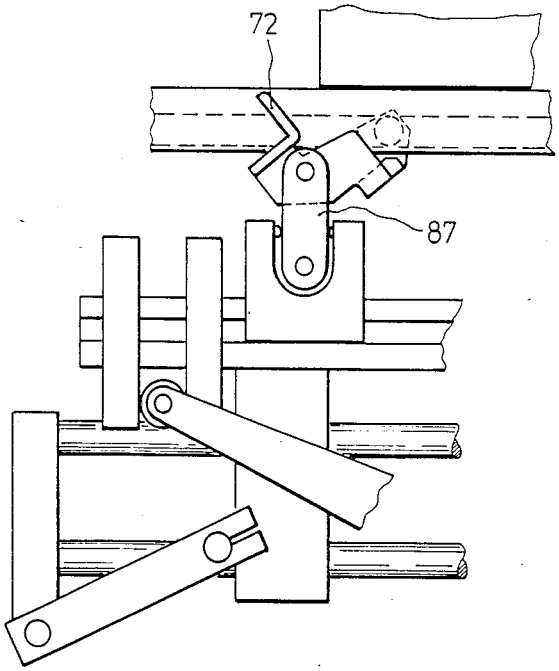
FIG. 7 is a side-elevation view of the transporter of FIG. 6 in a downwardly pivoted position.

The transporters 72 and 73 of transport units 82 and 83 are pivotally mounted so that they may be rotated into the pack unit clamping position depicted in FIG. 4. The transporters are guided, by means of guide rollers 80, in a track 86 formed in the center-most support beam 74 of table 57. Referring jointly to FIGS. 4, 5 and 7, the transporters 72 and 73 are engaged, at a point displaced away from the guide rollers 80, by H-shaped guide levers 87 which are mounted in the carriers 78. The guide levers 87 for the forwardly disposed transporters 73 are articulated to their respective carriers 78 and supported in their mounting via spring members 88. The spring mounting of the forward transporters 73 provides automatic compensation for manufacturing tolerances and dimensional changes of the packing material. Such compensation for dimensional changes is necessary because the packing material which is used, typically solid or corregated cardboard, is "living" material which can vary in size by 1–3% which changes in humidity. It is to be noted that such variations in packing material dimensions was, in the prior art, frequently the cause of interruptions in the operation of packaging machines and other related trouble.

A drive arm 90 engages, by means of a follow-up roller 91, a vertical guide 89 positioned adjacent one end of the rail 77. Drive arm 90 imparts movement to rail 77, and thus moves the slides 76 in a timed stepwise manner along the guide rods 75. Vertical movement of guide rods 75 results from the action of pivot arms 93 which engage holders 92 which support the guide rods 75 at the opposite ends thereof. The horizontal and vertical movement of rail 77, and thus of the transport units 82 and 83 which are mounted thereon, is effected by means of a cam mechanism which has not been illustrated in the drawing. This cam mechanism produces the rectangular motion path indicated in FIG. 1 at 71, of the transporters 72 and 73. The transporters 72 and 73, during their cyclical movement, are rotated counter-clockwise and clockwise to clamp and unclamp the pack units and move them in steps from station to station.

As will be obvious to those skilled in the art, the operation of the various other movable elements of the apparatus of the present invention will be adapted so as to occur at the proper time of the operational cycle of the conveying system. While the operation of these other elements will be discussed below, the means by which they are driven, and particularly the means for synchronizing such drives with the operation of the conveying system, have been omitted from the drawing in the interest of facilitating understanding of the invention. Implementation of the synchronized drive of the elements to be discussed below is within the capability of those skilled in the art and employs mechanisms known in the art.

After each article 2 to be packaged has been pushed onto the pre-folded packing material blank 1 in loading station B, the pivotal forward portion of the table 58 is raised. As the transporter 72 of transport unit 82 rotates upwardly, see FIG. 7, it will engage flap 1*e* and fold this flap upwardly. Simultaneously, the transporter 73 will rotate into position in front of the "pack unit". The pack unit will thus be aligned and centered between the transporters 72 and 73 of transport unit 82.

As the "pack unit" is conveyed by transport unit 82 to the first folding station C, a laterally mounted guide plate 100 will contact the front closure flap which adjoins the front side face 1*b* of the blank 1. At the same time, the upper side face 1*c* will be caused to run under a support rod of an upright folding stirrup member 101. The upright folding stirrup member 101, when the "pack unit" arrives at folding station C, will pivot downwardly as the transporters 72 and 73 are rotated out of contact with the pack unit. The downward pivoting of the folding stirrup member 101 will press the rear side face 1*d* of the blank 1 against the adhesively coated outer surface of flap 1*e*, i.e., the "industry edge". Due to the arrangement of the "industry edge" in the lower region of the partially completed package, reliable bonding will always be achieved because there will be a counter-pressure, which operates in the opposite direction to the pressure applied to folding stirrup member 101, produced by the presence of the article 2 within the "pack unit". While the "pack unit" is stationary at the first folding station C the upright inner closure flaps of the rear side face 1*d* will be folded inwardly through the action of a pair of laterally disposed pivotal folding fingers 102. Immediately after the application of the rear side face 1*d* to the "industry edge" 1*e*, and the inward folding of the closure flaps under the action of fingers 102, the transporters of transport unit 83 will rotate upwardly and clamp the "pack unit". The pack unit will then be conveyed to the second folding station D.

A plurality of nozzles 103 apply an adhesive to the upper and lower outer closure flaps during the transfer of the "pack unit" from the first to the second folding station. The upper and lower closure flaps are then, when the "pack unit" is stopped at folding station D, folded inwardly by means of upper and lower folding stirrup members 104. The folding members for the closure flaps of the upper side face 1*c* includes guide members 106 which are each provided with an outwardly curved guide face. The guide members 106 produce, during the closure flap folding movement, a right-angle alignment of the "pack unit" in the transport direction.

The lateral guide strips 53 serve to keep the inner closure flap closed and, in addition, provide a constrained guide for the "pack unit". A strong and firm package with exact angles is obtained as a result of the repeated central alignment of the "pack units" in the individual stations resulting from the engagement and clamping by the transporters, the alignment in the longitudinal direction in folding station D by guide members 106 and as a result of the guiding action of strips 53.

Figure 8:
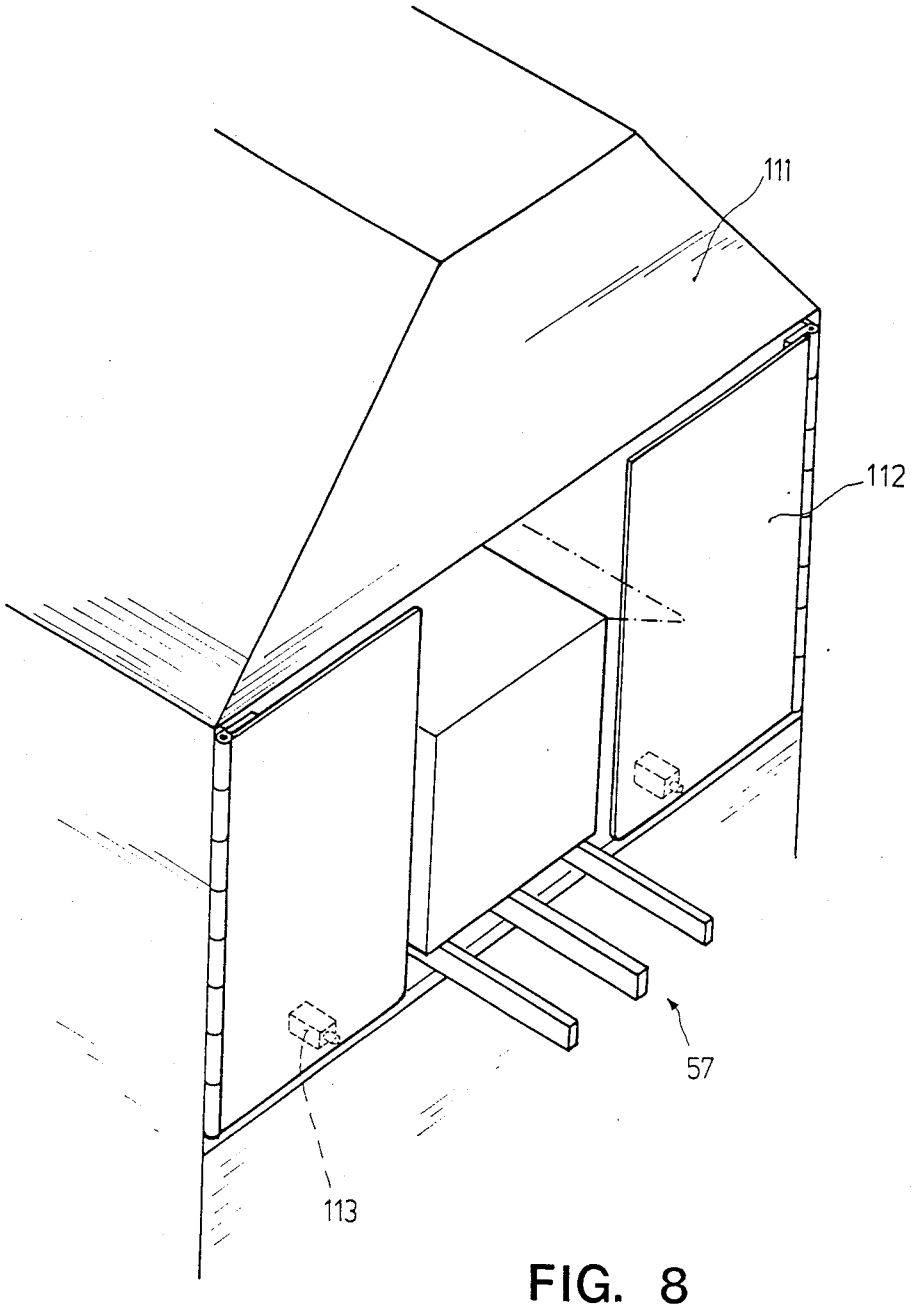
FIG. 8 is a perspective view of the discharge area of the packaging machine of FIG. 1.

FIG. 8 depicts the discharge region of the packaging machine, the machine including a guard 111 which must be closed for safety reasons. Pivotally suspended wing-type doors are provided at each side of the table 57, the space between doors 112 defining an exit opening for the completed packages. The doors 112 also provide an access opening for purposes of maintenance work. The doors 112 contact microswitches 113. If a package has not been properly completed, particularly if one of the closure flaps has not been adhesively bonded, such flap will contact one of the doors 112 thus causing the operation of a switch 113 and the generation of an alarm signal which indicates a faulty package.

It is to be noted that the invention is not limited to the embodiment described and shown herein, which is deemed to be illustrative of the best mode of carrying out the invention, and which is susceptible to modification of form, size, arrangement of parts and details of operation. The invention rather is intended to encompass all such modifications which are within its spirit and scope as defined by the claims.

What is claimed is:

1. A method of folding an initially flat package blank at least partly about an article so as to define a generally rectangular-shaped receptacle for the article, the blank having a plurality of regions which define parallel longitudinal fold lines, said longitudinal fold lines defining edges of adjoining sides of the receptacle, the blank further having portions which define closure flaps, said method comprising the steps of:

preforming the blank by bending about each of the side edge defining parallel longitudinal fold lines thereof to define an open-ended and open-sided packing having a bottom side, the preformed packing also having a front side which extends generally transversely with respect to the bottom side;

supporting the open-sided packing on its bottom side;

positioning an article to be packaged on the inwardly disposed face of the open-sided packing bottom side, the open-sided packing and article comprising a pack unit;

folding a first closure flap of the package blank inwardly to cause said flap to be orientated generally parallel with respect to the pack unit front side; and moving the pack unit to at least a first folding station by the application of force solely to the open-sided packing.

2. The method of claim 1 further comprising the step of:

folding additional closure flaps of the package blank inwardly at the folding station.

3. The method of claim 2 wherein the bending of the blank about the parallel longitudinal fold lines is effected in a series of successively performed operations.

4. The method of claim 3 wherein said additional closure flaps are connected to respective side defining portions by means of fold regions which extend generally transversely with respect to said longitudinal fold lines, and wherein the step of preforming the blank further comprising:

folding closure flap extending from the front side of the pre-formed packing so that said closure flap is orientated generally transversely with respect to said front and bottom sides.

5. The method of claim 1 wherein the package blank includes four sides, each side having at least one closure flap extending outwardly therefrom, a longitudinal fold zone being provided between each of said closure flaps and its associated side, said fold zones being generally transverse to said longitudinal fold lines, and wherein said first closure flap extends from the bottom side of the blank and is joined thereto by a further longitudinal fold line which is parallel to said longitudinal fold line of said plurality, the step of prefolding comprising:

causing the blank to assume a generally C-shaped configuration.

6. The method of claim 5 wherein the bending of the blank about the said parallel longitudinal fold lines, during the step of prefolding is effected in a series of successively performed operations.

7. The method of claim 1 wherein additional closure flaps are connected to respective side defining portions by means of fold regions which extend generally transversely with respect to said longitudinal fold lines, and wherein the step of preforming the blank further comprises:

folding a closure flap extending from the front side of the pre-formed packing so that said closure flap is orientated generally transversely with respect to said front and bottom sides.

8. Packaging apparatus for use in the folding of a packing material blank about an object to be packaged, the packing material blank including a plurality of side defining portions which are interconnected via longitudinally extending fold regions, said fold regions being generally parallel to one another, said side defining portions each having extending therefrom at least one closure flap, said closure flaps being connected to their respective side defining portions by means of fold lines which extend generally transversely with respect to said longitudinal fold regions, said blank further including a rear closure flap which extends from the free end of a first of the side defining portions thereof, said rear closure flap being separated from the first side defining portion by means of a further longitudinal fold region which is generally parallel to said other longitudinal fold regions, said apparatus comprising:

packing material blank prefolding means, said prefolding means causing deflection of each of said side defining portions relative to the adjoining side defining portions to define an open-sided packing;

object loading means, said loading means positioning an object to be packaged on a first face of said first side defining portion of the open-sided packing to define a pack unit;

conveying means for engaging the pack unit and moving the pack unit to a folding station, said conveying means including means for defining clamping planes adjacent to said longitudinal fold regions, said clamping plane defining means causing said rear closure flap to be folded inwardly to assume an orientation which is generally transverse to the object supporting first face whereby the object is captured between said rear closure flap and a second side defining portion of the packing material blank; and means for cyclically driving said conveying means whereby the pack unit will be caused to move slowly upon initial engagement by said clamping plane defining means during movement from said loading means to a first folding station.

9. The apparatus of claim 8 wherein said prefolding means includes:

means for separating individual packing material blanks from a magazine.

10. The apparatus of claim 9 wherein said prefolding means further comprises:

means for engaging said packing material blank first side defining portion and moving said first portion into a transport plane, and means for acting on a second side defining blank portion which adjoins said first portion to cause said second portion to assume an orientation which is generally transverse to said first portion when said first portion is positioned in the said transport plane.

11. The apparatus of claim 10 wherein said prefolding means additionally includes:

folding members for respectively acting on third and fourth side defining portions of the packing material blank to deflect said third and fourth portions relative to one another and to said first and second portions to define a generally C-shaped packing.

12. The apparatus of claim 11 further comprising:

means for applying an adhesive to the outwardly facing surface of said rear closure flap during the prefolding of said blank; and wherein said prefolding means includes:

a folding member which acts on said rear closure flap to cause the deflection thereof about the longitudinal fold region between said rear flap and the first side defining blank portion.

13. The apparatus of claim 12 wherein said prefolding means also comprises:

suction means for engaging the third side defining portion of the blank, said third portion being disposed between and connected to the second and a fourth side defining portions, said suction means effecting movement in a first direction of said third side defining portion; and fixed guide means for inhibiting movement of said fourth side defining portion during movement in said first direction of said third side defining portion whereby bending of said fourth side defining portion relative to said third side defining portion about the longitudinal fold region therebetween will occur.

14. The apparatus of claim 13 wherein said prefolding means further includes:

means for contacting a closure flap extending from said second side defining portion to cause said contacted second portion closure flap to assume an orientation which is generally transverse to said second portion.

15. The apparatus of claim 14 wherein said prefolding means causes initial folding of said side defining portions relative to one another about said longitudinal regions one at a time.

16. The apparatus of claim 14 wherein said conveying means comprises at least a pair of transport units, each of said transport units including clamping plane defining means, said transport units operating in synchronism to serially engage a pack unit to move the pack unit in step-wise fashion from said loading means to a first folding station and subsequently from the first folding station to a second folding station.

17. The apparatus of claim 16 wherein said clamping plane defining means each comprise:

a pair of engaging means, said engaging means being movable from below into and out of the path of movement of the pack unit.

18. The apparatus of claim 17 wherein said conveying means further comprising:

means for simultaneously driving said pairs of engaging means.

19. The apparatus of claim 18 further comprising:

driver means coupled to said transport units for motion therewith, said driver means engaging and pushing the pack unit out of the apparatus.

20. The apparatus of claim 10 wherein said conveying means defines a table which is coplanar with said transport plane and wherein said clamping plane defining means are angled and pivotal with a rotational movement to intercept the plane of said table, said clamping plane defining means including guide rollers which engage said conveying means defined table, said clamping plane defining means each further comprising a guide lever mounted in an adjustable carrier, said carriers being movable on said table to positions commensurate with the dimensions of the pack unit.

21. The apparatus of claim 20 wherein said clamping plane defining means each comprise:

a pair of pack unit engaging means, said engaging means being movable from below into an out of the path of movement of the pack unit.

22. The apparatus of claim 20 wherein at least one of said engaging means is resiliently biased toward the pack unit.

23. The apparatus of claim 20 wherein said object loading means comprises:

an introduction table, said introduction table having a pivotal forward portion;

support means disposed beneath the transport plane, the rear closure flap of the packing being clamped between said pivotal table portion and said support means during insertion of the objects to be packaged into the open-sided packing.

24. The apparatus of claim 20 further comprising: guide means disposed adjacent said conveying means defined table for folding inwardly closure flaps of the blank second side defining portions, said guide means effecting a right angle alignment of the pack unit in the longitudinal direction during movement thereof along said table.

25. The apparatus of claim 20 further comprising:

housing means, said housing means having pivotally suspended exit doors, said doors defining a package exit opening therebetween; and sensor means, said sensor means cooperating with said exit doors whereby projecting closure flap of a passing pack unit will contact one of said doors and thereby cause the associated sensor means to produce a signal.

26. The apparatus of claim 8 wherein said conveying means clamping plane defining means comprises:

a first pair of engaging means, said engaging means being movable from below into and out of the path of movement of the pack unit; and means for simultaneously driving said engaging means of said pair.

27. The apparatus of claim 8 further comprising:

means for applying an adhesive to the outwardly facing surface of said rear closure flap during the prefolding of said blank; and wherein said prefolding means includes:

a folding member which acts on said rear closure flap to cause the deflection thereof about the longitudinal fold region between said rear flap and the first side defining blank portion.

28. The apparatus of claim 8 wherein said prefolding means causes initial folding of said side defining portions relative to one another about said longitudinal regions one at a time.

29. The apparatus of claim 28 wherein said prefolding means includes means for folding an end closure flap which is integral with said second side defining portion whereby said end closure flap is orientated generally transversely with respect to both of said first and second side defining portions.

30. The apparatus of claim 8 wherein said conveying means comprises at least a pair of transport units, each of said transport units including clamping plane defining means, said transport units operating in synchronism to serially engage a pack unit to move the pack unit in step-wise fashion from said loading means to a first folding station and subsequently from the first folding station to a second folding station.

31. The apparatus of claim 30 wherein said clamping plane defining means each comprise:

a pair of pack unit engaging means, said engaging means being movable from below into an out of the path of movement of the pack unit.

32. The apparatus of claim 31 wherein said conveying means further comprising:

means for simultaneously driving said pairs of engaging means.

33. The apparatus of claim 8 wherein said prefolding means includes means for inwardly folding an end closure flap which is integral with said second side defining portion whereby said end closure flap is orientated generally transversely with respect to both of said first and second side defining portions.

34. Packaging apparatus for use in the folding of a packing material blank about an object to be packaged to define a generally rectangular shaped receptacle for the object, the packing material blank including a plurality of side defining portions which are interconnected via longitudinally extending fold regions, said fold regions being generally parallel to one another, at least some of said side defining portions having at least one closure flap extending therefrom, said closure flaps being connected to their respective side defining portions by means of fold lines which extend generally transversely with respect to said longitudinal fold regions, said blank further including a rear closure flap which extends from the free end of a first of the side defining portions thereof, said rear closure flap being separated from the first side defining portion by means of a further longitudinal fold region which is generally parallel to said other longitudinal fold regions, said apparatus comprising:

packing material blank prefolding means, said prefolding means causing deflection of each of said side defining portions relative to the adjoining side defining portions to define an open-sided packing having a bottom formed by said first side defining portion, said open-sided packing further having a front side defined by a second side defining portion which is adjacent to said first side defining portion, said front side extending generally transversely with respect to said bottom;

object loading means, said loading means positioning an object to be packaged on a first face of said first side defining portion of the open-sided packing to thereby define a pack unit; and conveying means for moving the pack unit to a folding station, said conveying means engaging only the open-sided packing comprising the pack unit, said conveying means including means for folding said rear closure flap inwardly to an orientation which is generally transverse to the object supporting first face of said first side defining portion whereby the object is captured between said rear closure flap and said second side defining portion of the packing material blank.

35. The apparatus of claim 34 wherein said prefolding means causes initial folding of said side defining portions relative to one another about said longitudinal fold regions one at a time.

36. The apparatus of claim 35 further comprising:

means for cyclically driving said conveying means whereby the pack unit will be caused to move solely upon initial engagement by said conveying means during movement from said loading means to a first folding station.

37. The apparatus of claim 36 wherein said prefolding means includes means for inwardly folding an end closure flap which is integral with said second side defining portion whereby said end closure flap is orientated generally transversely with respect to both of said first and second side defining portions.

38. The apparatus of claim 34 further comprising:

means for cyclically driving said conveying means whereby the pack unit will be caused to move solely upon initial engagement by said conveying means during movement from said loading means to a first folding station.

39. The apparatus of claim 34 wherein said prefolding means includes means for inwardly folding an end closure flap which is integral with said second side defining portion whereby said end closure flap is orientated generally transversely with respect to both of said first and second side defining portions.

* * * * *